US006340239B1

(12) United States Patent
Godbillon et al.

(10) Patent No.: US 6,340,239 B1
(45) Date of Patent: Jan. 22, 2002

(54) INDICATOR LIGHT WITH UNIFORM ILLUMINATING SURFACE FOR A MOTOR VEHICLE

(75) Inventors: Vincent Godbillon, Paris; Jean Claude Gasquet, Sens, both of (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 09/516,795

(22) Filed: Mar. 1, 2000

(30) Foreign Application Priority Data

Mar. 2, 1999 (FR) ..... 99 02666

(51) Int. Cl.[7] ..... B06Q 1/04; F21V 5/00

(52) U.S. Cl. ..... 362/521; 362/522; 362/268; 362/331; 362/336; 362/340

(58) Field of Search ..... 362/268, 521, 362/522, 331, 334, 520, 335, 336, 340

(56) References Cited

U.S. PATENT DOCUMENTS

| | | | | |
|---|---|---|---|---|
| 4,859,043 A | | 8/1989 | Carel et al. | |
| 5,287,101 A | * | 2/1994 | Serizawa | 362/521 |
| 6,019,492 A | * | 2/2000 | Ikegaya et al. | 362/521 |
| 6,231,221 B1 | * | 5/2001 | Godbillon et al. | 362/521 |

FOREIGN PATENT DOCUMENTS

| | | |
|---|---|---|
| FR | 2 507 741 | 12/1982 |
| FR | 2 614 969 | 11/1988 |
| FR | 2 772 112 | 6/1999 |

OTHER PUBLICATIONS

Patent Abstracts of Japan vol. 016, No. 051 (M–1209), Feb. 10, 1992 & JP 03 254004 A (Stanley Electric Co Ltd), Nov. 13, 1991.

French Search Report dated Oct. 22, 1999.

* cited by examiner

*Primary Examiner*—Thomas M. Sember

(74) *Attorney, Agent, or Firm*—Morgan & Finnegan, L.L.P.

(57) ABSTRACT

An indicator light comprises a source, an optical plate adapted to straighten out the incident light towards an average direction generally parallel to an optical axis, and a flux-distributing and recuperating cup interposed between the source and the plate in order to distribute the light over the inner surface of the plate. According to the invention, the optical plate has a height and a width of the same order of magnitude and possesses optical configurations having varied coefficients of transmission of the light, and the cup provides a given distribution of the light, both in the horizontal direction and in the vertical direction, which takes account of said coefficients. As a result, an illumination is obtained at the exit from said plate which is essentially constant in the horizontal direction as well as in the vertical direction.

15 Claims, 3 Drawing Sheets

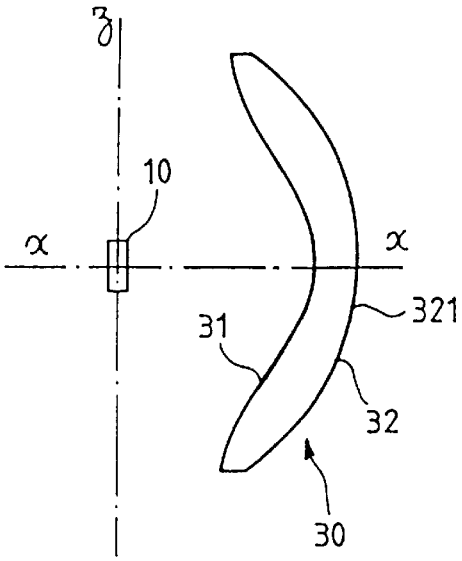
FIG_6
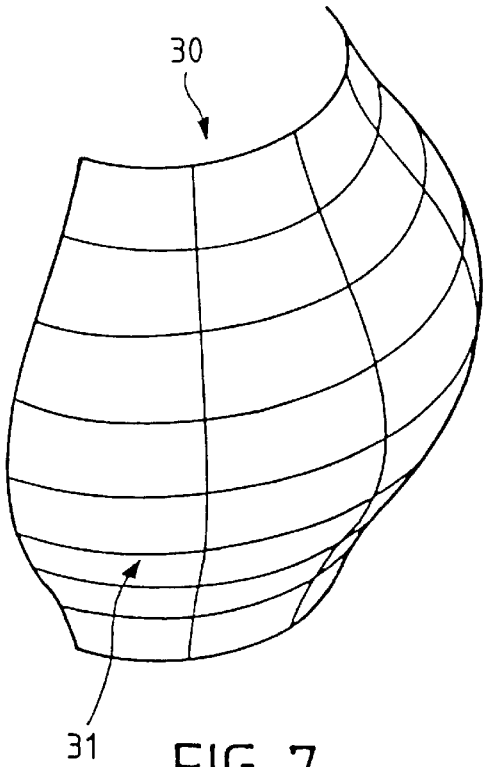
FIG_7
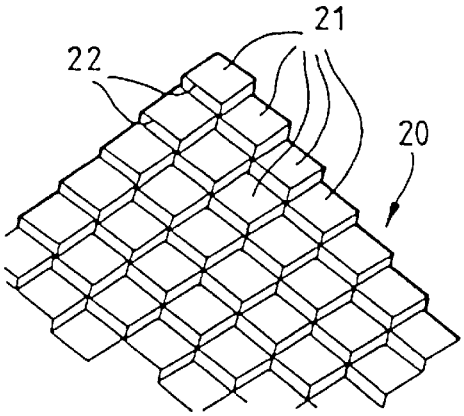
FIG_8
FIG_9
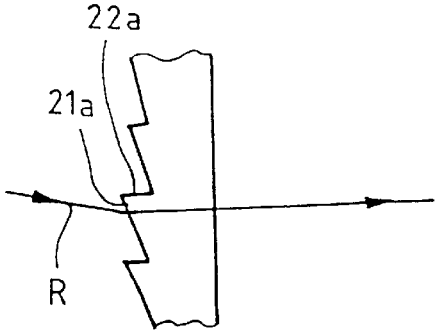
FIG_10
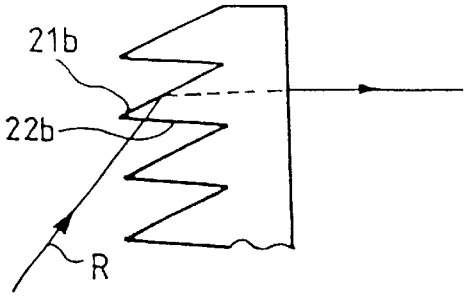

INDICATOR LIGHT WITH UNIFORM ILLUMINATING SURFACE FOR A MOTOR VEHICLE

FIELD OF THE INVENTION

The present invention relates to indicator lights for motor vehicles.

BACKGROUND OF THE INVENTION

There is currently an increasing preoccupation with the production of an indicator light which, when it is illuminated, exhibits an illuminating surface which is as uniform is possible, and does so for any observation position in the luminous field of the lamp.

The deficiencies of known indicator lights equipped with a single source (filament-type lamp) interacting with a rear recuperator mirror are an excess of light intensity in that region of the bezel which is situated in line with the lamp, and which is exposed to the greatest density of luminous flux. When optical configurations of the Fresnel lens type are used, in combination with the lamp, the same kind of problem is encountered, the central region of the lens emitting a flux density which is appreciably greater than its peripheral region.

There is also known, from the document FR-A-2 614 969 in the name of the Applicant, an indicator light which is designed to offer a relatively uniform luminous intensity of its illuminating surface, over a substantial width but over a limited height (elongate light). To this end it includes a filament-type lamp interacting with a cup for angular distribution of the light, which surrounds it closely, and an optical straightening plate reflecting the radiation received from the cup substantially into the axis of the light.

However, this known light does not completely solve the problem of the lack of uniformity, in the sense that the arrangements for straightening the light which are provided on the plate exhibit coefficients of transmission of the light which vary greatly from one place to another, and in particular according to the amount of straightening demanded, such that, ultimately, such a light retains an appreciably greater density of luminous flux in line with the lamp than towards the lateral edges of the lamp.

Furthermore, the teachings of this document apply in a limited away to a light of restricted height, and give no indication making it possible to deal with the case of a light the illuminating surface of which exhibits not only a substantial width but also a substantial height.

An object of the present invention is remedy these limitations of the state of the art.

DISCUSSION OF THE INVENTION

According to a first aspect of the invention, an indicator light for a motor vehicle comprises a light source, an optical plate possessing optical configurations adapted to straighten out the light originating from the region of the source so that it is propagated with an average direction generally parallel to a horizontal optical axis, and a flux-distributing and recuperating cup interposed between the source and the optical plate and adapted to provide a given distribution of the light over the inner surface of the optical plate in at least one given direction, characterized in that the optical plate has a height and a width of the same order of magnitude and possesses optical configurations exhibiting coefficients of transmission of the light which are different from one another, and in that the cup provides a given distribution of the light, both in the horizontal direction and in the vertical direction, which takes account of said different transmission coefficients so as to obtain an illumination at the exit from said plate which is essentially constant in the horizontal direction as well as in the vertical direction.

Preferred, but not limiting, aspects of the indicator light according to the invention are as follows:

- said optical configurations possess transmission coefficients which change in steps as a function of their position along at least one of the horizontal and vertical directions, and the given distribution of the light by the cup also changes in steps along said direction;
- in at least one area of said plate and along at least one direction, the transmission coefficients of the optical configurations vary progressively, and the given distribution of the light by the cup in the direction of this same area is also progressive;
- one of the faces of the cup is able to provide the desired distribution of the light in one of the horizontal and vertical directions, and the other face of the cup is able to provide the desired distribution of the light in the other direction;
- the outer face of the cup is able to provide the desired distribution of the light in the direction corresponding to the larger dimension of the optical plate;
- said outer face of the cup possesses a plurality of striations;
- the inner face of the cup is essentially smooth;
- the light source is a filament which is elongate along a direction corresponding to the smaller dimension of the optical plate; and
- the optical configurations of the optical plate are constituted by individual deflecting blocks operating either by refraction or by internal reflection.

According to a second aspect of the invention, there is provided a method of manufacturing a motor-vehicle indicator light, said light comprising a light source, an optical plate exhibiting horizontal and vertical dimensions of the same order of magnitude, and possessing first optical configurations adapted to straighten out the light originating from the region of the source so that it is propagated with an average direction generally parallel to a horizontal optical axis, said first optical configurations possessing different coefficients of transmission of the light, as well as a flux distributing and recuperating cup interposed between the source and the optical plate and including second optical configurations able to provide a given distribution of the light over the inner surface of the optical plate in the horizontal and vertical directions, characterized in that said method comprises the following stages:

- establishing a law of change of the transmission coefficients of said optical configurations as a function of the horizontal and vertical coordinates of these optical configurations on the plate;
- establishing, on the basis of said law, a relationship between the orientation of a ray originating from the source and incident on said second optical configurations and said horizontal and vertical coordinates, in such a way that the combination between said law and said relationship provides an essentially constant illumination at the exit from the plate along the horizontal and vertical directions;
- defining the geometry of said second optical configurations as a function of said relationship;
- manufacturing a mould for said cup by using said geometry; and molding the cup with the aid of said mould.

Preferred, but not limiting, aspects of the method of the invention are as follows:

- the stage of establishing a relationship is carried out while also taking account of an indicatrix of emission from the source in the direction in question;
- the stage of establishing a relationship is carried out while also taking into account a transmission coefficient of said second configurations;
- the definition stage consists in successively defining, over at least one of the faces of the cup, a plurality of second adjacent optical configurations as a function of the laws of refraction and/or of total reflection;
- the definition stage consists in defining, over at least one of the faces of the cup, a smooth surface forming second optical configurations in the continuity of one another as a function of the laws of refraction; and
- the definition stage comprises two separate and independent sub-stages applied respectively to the two faces of the cup and corresponding respectively to the horizontal direction and to the vertical direction.

Other aspects, aims and advantages of the present invention will be apparent on reading the following detailed description of a preferred embodiment thereof, given by way of non-limiting example.

BRIEF DESCRIPTION OF THE DRAWINGS

FIG. 6 is a view in vertical section of the detail of FIG. 4;

FIG. 7 is a view in perspective of the inner face of the optical distribution component;

FIG. 8 is a partial view in perspective of the inner face of an optical straightening component of the light of the invention; and FIGS. 9 and 10 illustrate in detail the optical behaviors of two types of optical configurations provided on the optical straightening component.

DESCRIPTION OF THE PREFERRED EMBODIMENTS OF THE INVENTION

Figure 1:
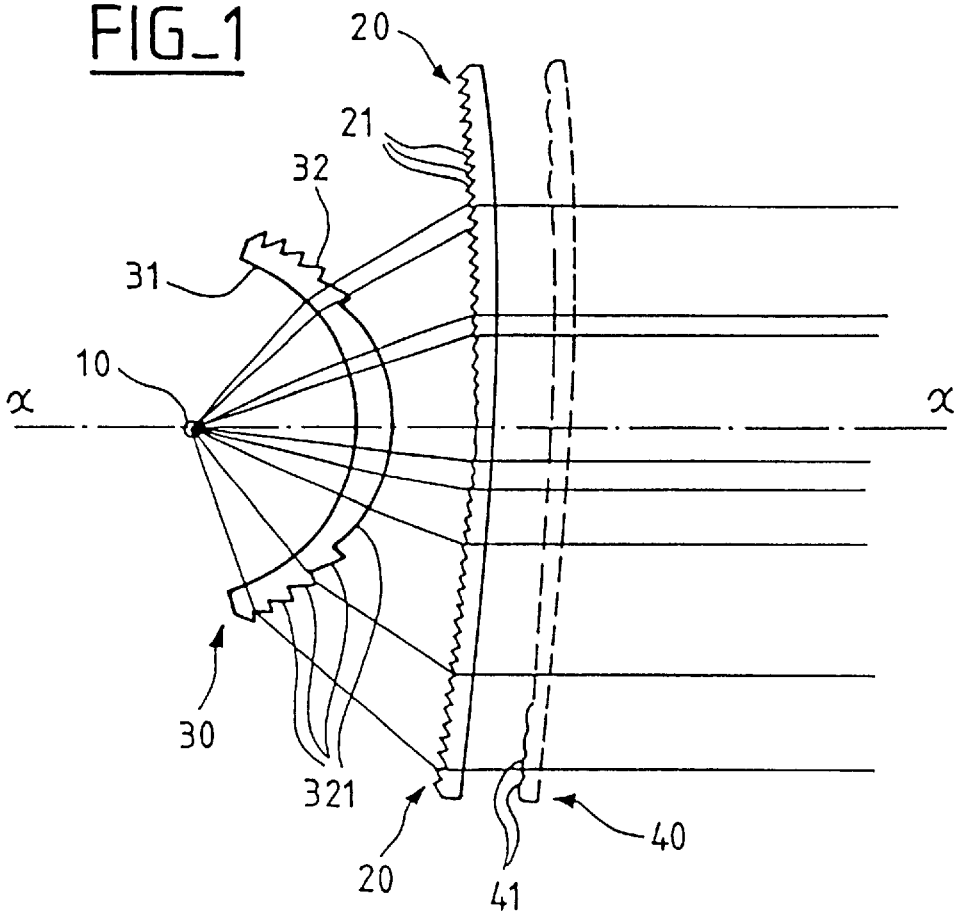
FIG. 1 is a diagrammatic view in horizontal section of an indicator light according to the invention.

Referring to the drawings, an indicator light comprises a light source 10, here the elongate filament of a standard indicator lamp, a flux-distributing element 30 in the general shape of a cup, a flux-straightening element 20 in the general shape of a plate, and a bezel 40 extending along and outside the plate 20. The light also comprises, in a way which is not represented but which is well known in itself, a base, a lamp holder, a connector, etc.

This light is represented in a right-angled reference system (0, x, y, z), x being the optical axis of the light, z being vertical and y perpendicular to x and to z, and 0 being situated at the center of the source 10.

The optical plate 20 and the bezel 40 possess dimensions in terms of height and width which are close to one another, and more generally of the same order of magnitude, that is to say that, when it is desired to obtain a uniform area of brightness at the exit from the light, the problems of uniform distribution of the illumination are posed in the horizontal direction as well as in the vertical direction.

Referring now more particularly to FIG. 1, the optical principle of the light of the invention lies in the fact that the cup 30 is able to divert the radiation which it receives from the source 10 so as to distribute it in terms of angle towards the inner face of the plate 20, this inner face possessing straightening optical elements 21 able to divert the incident light rays so that they are propagated essentially parallel to the optical axis x.

In the present example, the angular distribution of the light towards the plate 20 in the horizontal direction is carried out via the outer face 32 of the cup 30, which includes a set of generally vertical striations 321 carried on a spherical surface centered approximately on the center 0 of the source 10, and these vertical striations are designed with account being taken of the coefficients of luminous transmission of the various straightening optical elements 21, as well as of the transmission coefficient of each striation 321 itself, so that, at the exit from the plate 20, the density of luminous flux is essentially constant over its entire horizontal extent.

It will be understood in fact that, depending on the type of optical element 21 and depending on the amount of angular deviation of the light which is demanded of it, its optical transmission coefficient may vary very appreciably. Hence, FIG. 9 illustrates an optical element 21*a* operating by pure refraction, and it will be understood that, depending on the inclination of its entry face, which itself determines the height of the tapering surface which separates it from an adjacent entry face, the quantity of light lost varies widely.

FIG. 10 for its part illustrates an optical element 21*b* operating by internal reflection, the luminous transmission coefficient of which may also be found to be different depending on the overall deviation demanded, and also because of the losses in terms of the reflection in the region of the oblique face of the element.

Hence the present invention makes it possible to overcome these variations, whether they are progressive or in steps (the cup then respectively producing variations which are progressive or in steps), and to deliver a uniform flux.

Figure 5:
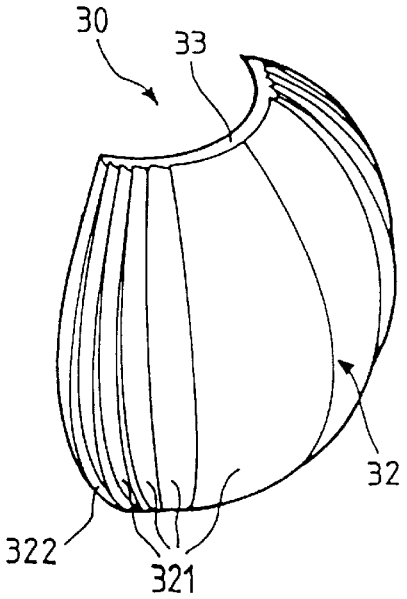
FIG. 5 is a view in perspective of the outer face of the optical distribution component.

In physical terms, the profile of the various striations 321 of the cup is determined by computer-assisted design means, by first of all establishing a law of variation of the transmission coefficients of the elements 21 as a function of their horizontal dimension along y, and by integrating this law into the calculation which, for a given angle towards the side, of a ray originating from the source 10, determines the angle of the ray leaving the cup 30 towards the plate 20. In practice, the outer face of the cup is produced by calculating its profile in the axial horizontal plane x0y, then by carrying out a homothetic shifting of this profile parallel to itself between meridian guides so as to obtain the surface as illustrated in FIG. 5.

Figure 2:
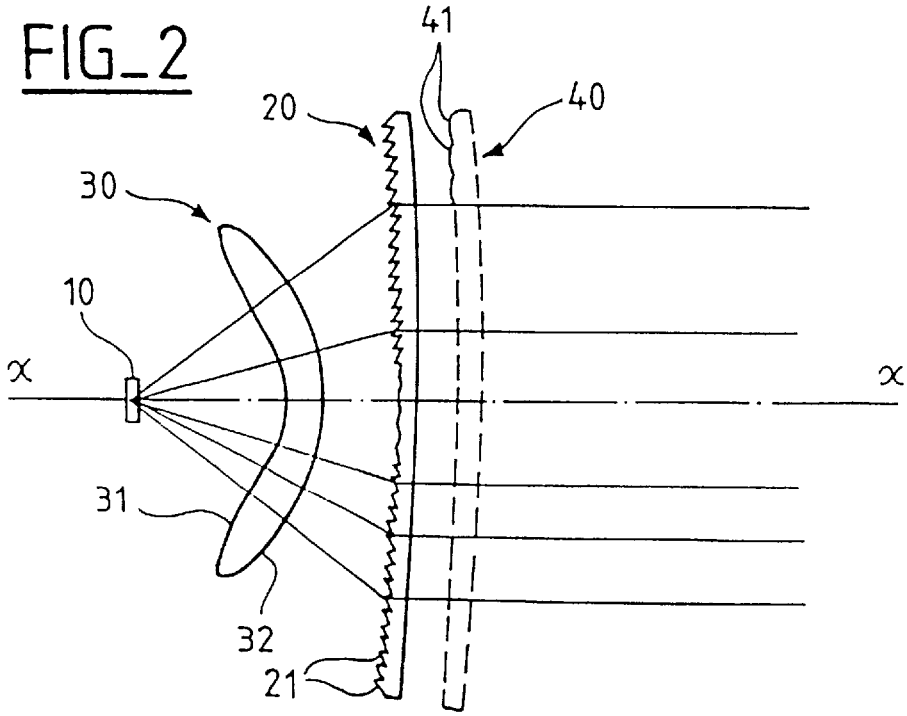
FIG. 2 is a diagrammatic view in vertical section of the light of FIG. 1.
Figure 3:
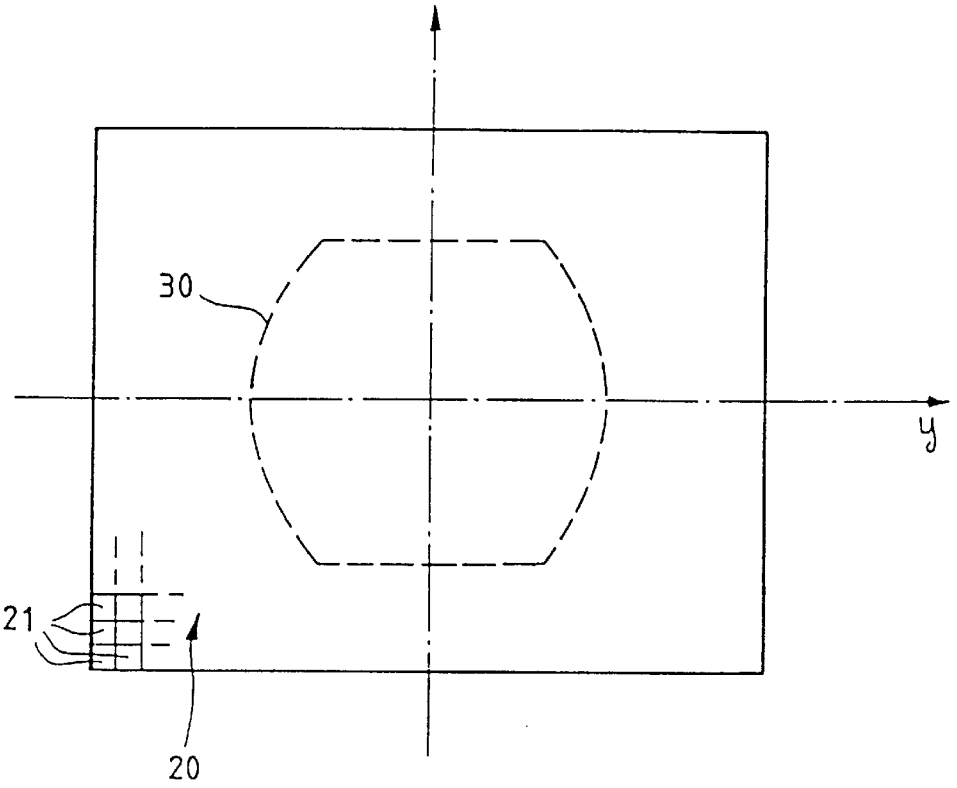
FIG. 3 is a partial diagrammatic front view of the light of FIGS. 1 and 2.
Figure 4:
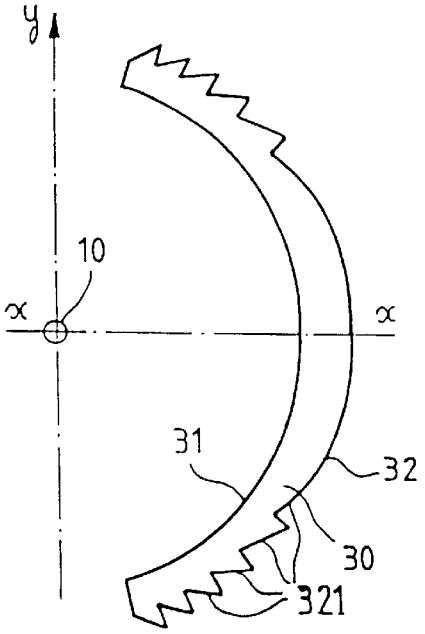
FIG. 4 is a view in horizontal section of a detail of the light of FIGS. 1 to 3, including an optical distribution component.

In the same spirit, and by reference now to FIG. 2, the inner face 31 of the cup 30 is designed so as to obtain the same result in the vertical direction. In other words, a law of variation of the transmission coefficients of the straightening elements 21 is determined along the z direction, and this law is integrated into the calculation which, for a given angle upwards or downwards of a ray originating from the source 20, determines the angle of the outgoing ray.

It is observed here, particularly from FIGS. 2 and 6, that the distribution work carried out by the inner face 31 of the cup 30 may, in the present example, be carried out by the use of a smooth surface, and thus one without tapers and without losses of luminous efficiency. It is also observed that the optimal surface in the present embodiment is an inwards-curved surface characterized by two points of inflection substantially at mid-height between the optical axis and the upper end 33 of the cup, and at mid-height between the optical axis and the lower end of the cup.

In order for the vertical distribution 6f the light to be assured in any vertical plane inclined leftwards or rightwards with respect to the axial vertical plane x0z, the inner surface 31 of the cup is preferably generated by a rotation of the profile as illustrated particularly in FIG. 6 about the vertical axis z.

Alternatively, it is possible, for example, to define three sections of the inner surface 31 of the cup, one in the axial vertical plane x0z and the other two in the vertical planes containing the lateral edges of the cup, and to produce the whole of the surface by interpolation between these various sections.

In order further to reinforce the uniformity of the distribution of the light in the vertical direction, it may be beneficial, in the design of the vertical distribution surface 31, to take account of the indicatrix, or transmission polar diagram, of the source, knowing that, inherently, a source which here is oriented vertically will appear less bright in proportion to the angular deviation, upwards or downwards, from the optical axis x.

Hence, overall, a radiation is obtained at the exit from the plate 20 which is propagated substantially parallel to the axis x over the entire extent of the plate, and the flux density of which remains essentially constant over the entire extent of the plate.

This radiation is then diffused, in a way which is known in itself, by optical diffusion configurations go 41 such as rings or balls, which are provided on the inner face of the bezel 40.

It will be observed here that the present invention applies to optical plates 20 and to bezels 40 which are generally flat or slightly curved, as illustrated, as well as to optical plates and to bezels exhibiting a pronounced curvature, the geometry of the plate 20 in particular being easily taken into account by the computer-assisted design facilities.

Moreover, it will be understood that, the more the cup 30 is closed around the source, both horizontally as well as vertically, the better is the recovery of the luminous flux emitted by the source, and thus the higher the efficiency of the light.

However, the fact of producing a cup which is too closed, for example up to 90° or more, both laterally on either side of the optical axis x as well as above and below this same axis x, may pose problems in design and in removing the cup from the mould.

It has been observed in this regard that, if the greatest angular extent to be obtained in order to cover the extent of the plate 20 is, for example, in the horizontal direction, then it is particularly beneficial to orient the elongate filament of the lamp in the vertical direction. This is because, with such an orientation, the radiation pattern, or indicatrix of the filament is such that it is in this position that it is possible to attenuate the angular coverage of the cup around the lamp, in the vertical direction, without to any extent being faced with excessive losses of flux. Hence it is possible to demonstrate that, for example if the angular coverage of the cup is ±60° above and below the axis x, then more than 95% of the flux which would be recovered with a cup covering ±90° vertically is already recovered. With this reduction in the vertical extent having been achieved, it is then possible without difficulty to provide an angular coverage close to 90° , since with the source in the vertical position, each degree gained along this direction contributes to reinforcing the luminous flux sent on towards the plate 20.

The present invention is not in any way limited to the embodiment described above and represented in the drawings, but includes any variant or modification within its scope.

In particular, the plate 20 may include non-contiguous working regions separated by smooth areas which, when the light is extinguished, make it possible to see the inside thereof, in order thus to confer a visual impression of depth. In this case, the cup 30 is designed so as to send substantially no luminous flux towards the smooth areas, while distributing the light towards the working areas as described above.

According to another embodiment, the light may additionally include a mirror interacting with smooth areas of the plate 20 and the activity of which is localized in the region of these smooth areas. These smooth areas are, for example, situated in the region of the edges of the light, and the central region of the plate 20 then interacts with the cup 30 as described above. The mirror may be smooth (consisting typically of axisymmetric portions of a paraboloid) or produced with steps particularly in order not to increase the depth of the light. It may be provided with a coating of the metallised type, and/or receive a diffusing treatment.

What is claimed is:

1. An indicator light for a motor vehicle comprising a light source, an optical plate having optical configurations adapted to straighten out the lighting originating from a region of the source so that it is propagated with an average direction generally parallel to a horizontal optical axis, and a flux-distributing and recuperating cup interposed between the source and the optical plate and adapted to provide a given distribution of the light over the inner surface of the optical plate in at least one given direction, wherein the optical plate has a height and a width of the same order of magnitude and possesses optical configurations exhibiting coefficients of transmission of the light which are different from one another, and wherein the cup provides a given distribution of the light, both in the horizontal direction and in the vertical direction, which takes account of said different transmissions coefficients so as to obtain an illumination at the exit from said plate which is essentially constant in the horizontal direction as well as in the vertical direction.

2. The indicator light as claimed in claim 1, wherein said optical configurations have transmission coefficients which change in steps as a function of their position along at least one of the horizontal and vertical directions, and wherein the given distribution of the light by the cup also changes in steps along said direction.

3. The indicator light as claimed in claim 1, wherein, in at least one area of said plate and along at least one direction, the transmission coefficients of the optical configurations vary progressively, and wherein the given distribution of the light by the cup in the direction of this same area is also progressive.

4. The indicator light as claimed in claim 1, wherein one of the faces of the cup is adapted to provide the desired distribution of the light in one of the horizontal and vertical directions, and wherein the other face of the cup is adapted to provide the desired distribution of the light in the other direction.

5. The indicator light as claimed in claim 4, wherein the outer face of the cup is adapted to provide the desired distribution of the light in the direction corresponding to the larger dimension of the optical plate.

6. The indicator light as claimed in claim 5, wherein said outer face of the cup is provided with a plurality of striations.

7. The indicator light as claimed in claim 5, wherein the inner face of the cup is essentially smooth.

8. The indicator light as claimed in claim 1 wherein the light source is a filament which is elongate along a direction corresponding to the smaller dimension of the optical plate.

9. The indicator light as claimed in claim 1, wherein the optical configurations of the optical plate are constituted by individual deflecting blocks operating either by refraction or by internal reflection.

10. A method of manufacturing a motor-vehicle indicator light, which light comprises a light source, an optical plate having horizontal and vertical dimensions of the same order of magnitude, and possessing first optical configurations adapted to straighten out the light originating from a region of the source so that it is propagated with an average direction generally parallel to a horizontal optical axis, said first optical configurations having different coefficients of transmission of the light, and a flux distributing and recuperating cup interposed between the source and the optical plate and including second optical configurations able to provide a given distribution of the light over the inner surface of the optical plate in the horizontal and vertical directions, said method comprising the stages of:

establishing a law of change of the transmission coefficients of said optical configurations as a function of the horizontal and vertical coordinates of these optical configurations on the plate;

establishing, on the basis of said law, a relationship between the orientation of a ray originating from the source and incident on said second optical configurations and said horizontal and vertical coordinates, in such a way that the combination between said law and said relationship provides an essentially constant illumination at the exit from the plate along the horizontal and vertical directions;

defining the geometry of said second optical configurations as a function of said relationship;

manufacturing a mould for said cup by using said geometry; and molding said cup with the aid of said mould.

11. The method as claimed in claim 10, wherein stage of establishing a relationship is carried out while also taking account of an indicatrix of emission from the source in the direction in question.

12. The method as claimed in claim 10, wherein the stage of establishing a relationship is carried out while also taking into account a transmission coefficient of said second configurations.

13. The method as claimed in claim 10, wherein the definition stage consists in successively defining, over at least one of the faces of the cup, a plurality of second adjacent optical configurations as a function of the laws of refraction and/or of total reflection.

14. The method as claimed in claim 10, wherein the definition stage consists in defining, over at least one of the faces of the cup, a smooth surface forming second optical configurations in the continuity of one another as a function of the laws of refraction.

15. The method as claimed in claim 10, wherein the definition stage comprises two separate and independent sub-stages applied respectively to the two faces of the cup and corresponding respectively to the horizontal direction and to the vertical direction.

* * * * *